US007036507B2

(12) United States Patent
Jensen

(10) Patent No.: US 7,036,507 B2
(45) Date of Patent: May 2, 2006

(54) FILTER MASK

(75) Inventor: John W. Jensen, Kaysville, UT (US)

(73) Assignee: Alpha Pro Tech Inc., Valdosta, GA (US)

( * ) Notice: Subject to any disclaimer, the term of this patent is extended or adjusted under 35 U.S.C. 154(b) by 48 days.

(21) Appl. No.: 10/739,245

(22) Filed: Dec. 18, 2003

(65) Prior Publication Data

US 2005/0133034 A1 Jun. 23, 2005

(51) Int. Cl.
*A62B 7/10* (2006.01)

(52) U.S. Cl. ..... 128/206.19; 128/205.29; 128/206.12; 128/206.13

(58) Field of Classification Search ..... 128/205.25, 128/205.29, 206.12, 206.13, 206.19
See application file for complete search history.

(56) References Cited

U.S. PATENT DOCUMENTS 2,752,916 A 7/1956 Haliczer ..... 128/206.19
3,603,315 A * 9/1971 Becker, III ..... 128/206.19
3,971,369 A 7/1976 Aspelin et al. ..... 128/206.19
3,985,132 A * 10/1976 Boyce et al. ..... 128/206.19
4,300,549 A * 11/1981 Parker ..... 128/206.19
4,688,566 A * 8/1987 Boyce ..... 128/206.19
5,699,791 A * 12/1997 Sukiennik et al. ..... 128/206.13
5,724,677 A * 3/1998 Bryant et al. ..... 2/206
6,332,465 B1 * 12/2001 Xue et al. ..... 128/207.11
6,336,459 B1 * 1/2002 Miyake et al. ..... 128/857
6,484,722 B1 * 11/2002 Bostock et al. ..... 128/206.19

* cited by examiner

*Primary Examiner*—Henry Bennett
*Assistant Examiner*—Andrew Bunin
(74) *Attorney, Agent, or Firm*—Trexler, Bushnell, Giangiorgi, Blackstone & Marr, Ltd.

(57) ABSTRACT

The invention provides a filter mask for filtering air inhaled and exhaled from the mouth and nostrils while providing a positive facial lock at all edges of the mask. The filter mask has upper and lower edges which are provided with malleable stiffeners for conforming to the shape of the wearer's nose and cheek area and the lower jaw and chin area, respectively. The material of the filter mask is folded to have an omega pleat for forming a breathing chamber and a secondary pleat for assisting in securing the mask to the lower jaw and chin area. A pair of headbands are used to hold the mask on the head. The peripheral edges of the mask are bound. The mask provides excellent filtration since the positive facial lock around all edges of the mask substantially prevents air from leaking between the mask and the face.

28 Claims, 3 Drawing Sheets

FILTER MASK

BACKGROUND OF THE INVENTION

The invention relates to filter masks which isolate both the mouth and nostrils of a wearer from the surrounding environment. More particularly, the invention relates to a filter mask which provides a positive facial lock while requiring only a headband to secure the filter mask to the wearer's head.

There are many situations today where it is necessary to filter the air which is inhaled and exhaled. Such filtration is primarily concerned with removal of small particulate matter, such as dirt or bacteria, as opposed to gases or liquids, from the air. Perhaps the most common instance in which a filter mask is used is in the medical arts. However, the same filter masks which have application in the medical arts are also, in many cases, well suited for use in industrial and domestic applications as well.

In the medical arts, filter masks are often used to prevent nasopharyngeal organisms and materials which are exhaled by the wearer from entering the surrounding environment. The same mask may also be used to protect the wearer from inhaling harmful microorganisms. In both applications, it is important that the filter mask be fabricated from a material which exhibits a high bacterial filtration efficiency (BFE) and also have a structure that prevents the migration of microorganisms across the filter medium. One of the more common applications of filter masks in the medical arts is the wearing of masks by a surgical team while performing surgical procedures. A mask worn during surgical procedures, for example, must provide proper BFE while still being comfortable for the wearer who may be wearing the same mask for several hours.

In the industrial arts it is often necessary for individuals working in "clean room" environments to avoid the introduction of any particulate manner, including microorganisms which may be exhaled by the wearer, into the clean room environment. Some clean room environments may be significantly more "clean" (i.e., particle free) than the required level of cleanliness in some surgical operating room environments. Such clean rooms are required when fabricating what are termed very large scale integrated circuits (VLSIC) which are at the heart of modern electronic computers. As in the medical arts applications, industrial applications may require the workers to wear their filter masks for extended periods of time. Therefore, considerations of comfort and durability are of prime importance.

Other industrial applications require the filtration of the air which is inhaled by the wearer. Often construction or agricultural workers will be working in a "dirty" environment in which the air would be harmful to breathe if it were not filtered. Many times filter masks are used in such circumstances to protect the wearer from harm.

Besides the medical and industrial applications there are domestic applications for such masks in the home. Many hobbyists have uses for an efficient and comfortable filter mask. For example, an individual applying paint by means of a spray gun desires to ensure that the airborne droplets of paint are not inhaled. While filter masks may have application in a wide variety of fields, as exemplified in the prior discussion, it can be seen that the design requirements of filter masks to be used in these different applications share many common design criteria such as proper filtration, comfort and durability.

Regardless of te application, there are several considerations which must be raised when designing a filter mask to be worn by a human. First, the material used as the filter material must have the characteristic of preventing the passage of the size of particles which are desired to be filtered. The size of particles may vary between 10 micromillimeters or smaller in the case of a bacterium, to a millimeter or more in the case of particles of dirt and dust. Furthermore, while still maintaining proper filtration efficiency, the filter material must allow for the passage of air without undue resistance. Also, the full benefits of the filter mask will not be realized if inhaled or exhaled air is allowed to leak around the edges of the filter material where the mask is not held securely against the wearer's face. Thus, if a positive facial lock is not maintained, the purpose of the mask may be defeated and the mask could be of little use.

Furthermore, the mask must be economical since most users of filter masks dispose of the mask after a single use. Still further, some applications may require that masks be changed regularly, for example every few hours when the wearer is working at an extremely dusty construction site. This consideration requires that both the materials used to construct the mask, and the method used to fabricate the mask, be such that costs are kept low. Furthermore, it is generally very desirable to design a mask which may be stored in a very small space. Generally, a flat storage configuration provides for the most compact storage.

Of immediate concern to the wearer of the mask is the comfort of the mask while it is on the wearer's face. Generally, the mask will be most comfortable if contact with the mouth is avoided. If the filter material contacts the wearer's mouth, the comfort, and often the integrity, of the mask is generally reduced. Furthermore, as various liquids from the wearer's face collect, such as perspiration and saliva, the portions of the mask held against the face may become saturated with liquid, thus reducing the comfort of the mask as well as presenting the potential risk of transferring microorganisms from one side of the filter material to the other. Still further, a filter mask should be relatively quick and easy to install, that is to place on the face, and should remain in the proper position while the wearer continues his ordinary activities.

In the prior art, many attempts were made to achieve some or all of these desirable characteristics in a filter mask. For example, U.S. Pat. No. 3,971,369 discloses a surgical face mask in which the filter material is folded so as to form a cup shape to prevent the filter material from resting against the face of the wearer. Still further, U.S. Pat. No. 4,300,549 discloses a filter mask which is provided with both pleats in the filter material and conformable stiffening members which are embedded within the filter material so that the filter material is held away from the wearer's face. U.S. Pat. No. 2,752,916 discloses a face mask which is held on the head by the use of a single headband which increases the ease with which the mask is placed on the wearer's face.

None of these masks, however, addressed the problem of excessive "leaking" of air around the edges of the filter material, a common problem with nearly all masks available in the prior art.

U.S. Pat. No. 4,688,566 disclosed a mask which sought to solve this problem. The mask of the '566 patent has upper and lower edges which are provided with moldable stiffeners for conforming to the shape of the wearer's nose and cheek area and the lower jaw and chin area, respectively. The lower edge is folded so as to form a reverse pleat which conforms to the shape of the lower jaw. A single headband may be used to hold the mask on the head. The peripheral edges of the mask are bound. While the reverse pleat was good if only one headband was to be used, but it did not allow for the best fit possible on some face sizes and shapes. The reverse pleat uses up materials that could be used to obtain a better fit.

Thus, there is a need for a mask which overcomes the foregoing problems, but which also provides for a better fit on a wider range of facial sizes and shapes. The present invention provides such a mask.

OBJECTS AND SUMMARY OF THE INVENTION

A primary object of the invention is to provide a filter mask which provides a good fit on a wide range of facial sizes and shapes.

An object of the invention is to provide a filter mask which effectively filters either inhaled or exhaled air from the nostrils or the mouth of the wearer.

Another object of the invention is to provide a filter mask which maintains a positive facial lock thus preventing leakage of material around the edges of the mask.

Yet another object of the invention is to provide a filter mask which exhibits a high bacterial filtration efficiency while still maintaining the comfort of the wearer.

Still another object of the invention is to provide a mask which resists collapsing on the mouth of the wearer thus causing discomfort.

Another object of the invention is to provide a filter mask which does not shed fibers or other bits of particulate matter.

Yet another object of the invention is to provide a filter mask which does not allow exhaled vapors or particulates to escape through the edges of the mask.

Still another object of the invention is to provide a filter mask which is light weight and which may be stored in a compact configuration.

Briefly, and in accordance with the foregoing, the invention provides a filter mask for filtering air inhaled and exhaled from the mouth and nostrils while providing a positive facial lock at all edges of the mask. The filter mask has upper and lower edges which are provided with malleable stiffeners for conforming to the shape of the wearer's nose and cheek area and the lower jaw and chin area, respectively. The material of the filter mask is folded to have an omega pleat for forming a breathing chamber and a secondary pleat for assisting in securing the mask to the lower jaw and chin area. A pair of headbands are used to hold the mask on the head. The peripheral edges of the mask are bound. The mask provides excellent filtration since the positive facial lock around all edges of the mask substantially prevents air from leaking between the mask and the face.

BRIEF DESCRIPTION OF THE DRAWINGS

The features of the invention which are believed to be novel are described in detail hereinbelow. The organization and manner of the structure and operation of the invention, together with further objects and advantages thereof, may best be understood by reference to the following description taken in connection with the accompanying drawings wherein like reference numerals identify like elements in which.

DETAILED DESCRIPTION OF THE ILLUSTRATED EMBODIMENT

Figure 2:
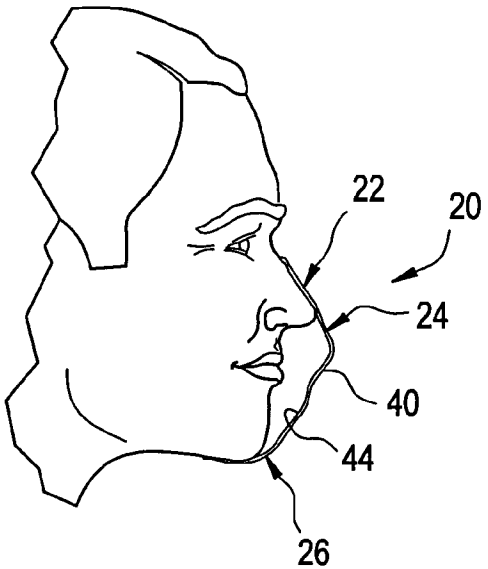
FIG. 2 is a cross-sectional view of the filter mask illustrated in FIG. 1.

While this invention may be susceptible to embodiment in different forms, there is shown in the drawings and will be described herein in detail, a specific embodiment with the understanding that the present disclosure is to be considered an exemplification of the principles of the invention, and is not intended to limit the invention to that as illustrated.

Figure 1:
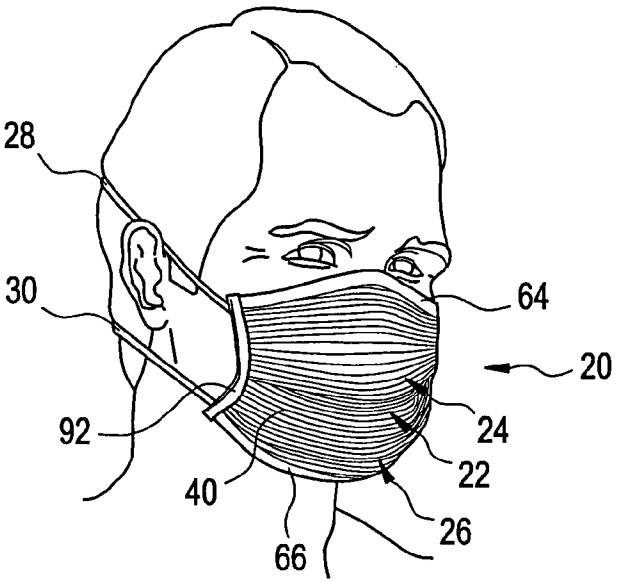
FIG. 1 is a perspective view of an embodiment of a filter mask of the present invention installed upon a wearer's face.

FIG. 1 is a perspective view of a filter mask 20 installed upon the face and head of the wearer. The filter mask 20 may have application in medical, industrial, domestic, or other circumstances.

The filter mask 20 is generally configured so as to provide a positive facial lock which prevents passage of any material between the nostrils and mouth and the surrounding environment except through the filter material 22. The makeup of the filter material 22, and the pleating 24, 26 used in connection with the filter mask 20 will be explained in detail shortly. The filter mask 20 has the particular advantage of allowing a positive facial lock to be created and maintained upon installation of the filter mask 20 on the face with the use of two headbands 28, 30.

The filter mask 20 may be constructed of a wide variety of materials. Perhaps the first consideration to be addressed when selecting an appropriate material is whether it is desirable to fabricate a filter mask which is disposable. The term disposable generally means that the cost of the filter mask is such that it may be disposed of after only a single use. Generally, the vast majority of filter masks used in surgical and industrial applications are of the disposable type. Thus, while it should be appreciated that materials which are intended to be reused a number of times can be adapted for use with the present invention, the filter mask set forth herein will be described using only disposable materials.

While it may initially appear that disposing a filter mask after a single use increases the cost per use, such is often not the case. When the cost of preparing a reusable filter mask (e.g., sterilizing the mask) for reuse is considered, it is often less expensive to use a disposable filter mask. Furthermore, the art of preparing materials which are to be used as filter materials for disposable filter masks has advanced to the point where such materials are as efficient, or more efficient, than the previously available non-disposable materials. An example of such non-disposable materials are the linen materials that have bee used in the past for filter masks. Furthermore, it must be appreciated that even though the filter mask 20 described herein is termed disposable, it may, in some applications, be reused many times without substantial loss of efficiency. Another advantage of the present invention is that the filter mask 20 may generally be reused even if it is crushed or bent. For example, a construction worker might fold the filter mask 20 and place it in his pocket for later use. Because of the features of the filter mask 20 as described herein, the filter mask 20 would generally still be usable.

The filter material 22 used to fabricate the filter mask 20 may vary according to the particular application of the filter mask 20. For example, when the filter mask 20 is to be used in a medical application, such as on members of a surgical team, it is common to use a three layer filter material. However, appropriate filter materials may be of a single or multiple layer design. Multi-layer material may be readily purchased in a precollated form, that is with the three layers already arranged, or the materials may be obtained separately and the filter material 22 formed in part of the process for forming the filter mask 20.

Generally, a three or four layer filter medium might include an outer layer of a relatively porous paper-like material which provides durability and resistance against abrasion. The outer layer may also be generally stiffer than the other layers. By using a stiffer outer layer the effectiveness of the various pleating arrangements is increased. The pleating arrangements may be incorporated in the body of the filter material 22 to hold the filter mask 20 in a cup-like shape when installed. The middle layer or layers of the filter material generally consist of polyethylene or polypropylene, or other material, which exhibits the proper filtration characteristics. Glass fiber based materials may also have applications as the middle filtration layer. The innermost layer to be worn next to the face is generally comprised of a soft material for providing a soft, non-irritating surface against which the facial skin will make contact.

In medical applications, it is generally important that the filter material 22 also provide a high bacterial filtration efficiency (BFE). The BFE of a filter material is generally arrived at by determining the percentage of bacteria, such as *Staphylococcus aureus* or *Bacillus stearothermophilus*, that is able to migrate through the filter material under normal conditions. The fewer bacteria which are able to pass through the filter material 22, the higher the BFE. Of course, a BFE of 100% is desirable, however, efficiencies of as low as 25% are not uncommon among some types of prior art disposable filter masks. However, materials are available which provide BFE's of between 90 and 99%. Thus, in a medical environment it is generally desirable to utilize a filter material having as high a BFE as possible so as to prevent release of nasopharyngeal organisms into the environment.

In general, the considerations that provide for a high BFE are the same considerations which provide that a filter material would be desirable in applications in industry and domestic use. For example, a filter material which inhibits the migration of nearly all bacteria, would generally also prevent inhalation of dust and dirt particles in industrial applications. Furthermore, it has generally been found that those materials providing a high BFE are often also those materials which provide the least resistance to passage of gases through the filter material. The passage of gases through the filter material is of great importance in maintaining the comfort of the wearer, a consideration to be discussed shortly. It should be realized, however, that many applications might require greater or lesser standards of filtration than is commonly required in the medical environment.

Thus, while filter materials having an efficiency suitable for use with the present invention are available in the art, the best filter material is of little use if the air inhaled and exhaled by the wearer is allowed to escape around the upper or top, lower or bottom and side edges 32, 34, 36, 38 of the filter mask 20 without passing through the filter material 22. Indeed, the lack of a positive facial lock in the filter masks available in the prior art is of critical concern to those involved in the design and fabrication of filter masks. Thus, the present invention, while using materials generally available as a filter material 22, provides a unique positive facial lock which prevents inhaled and exhaled air from escaping around the edges 32, 34, 36, 38 of the filter mask 20, all the while providing a superior fit on a wider range of facial sizes and shapes. The maintenance of such a positive facial lock greatly improves the overall efficiency of the filter mask 20.

The structure used in the present invention to provide a positive facial lock upon installation, but which also provides a superior fit on a wide range of facial sizes and shapes, will now be described.

The structure of the filter mask 20 illustrated in FIGS. 1–7 may be best explained by discussing a representation of some of the major steps in the fabrication of the filter mask 20. The filter material 22, which is chosen giving due concern to the considerations listed above, is generally prepared as a rectangular piece of flat filter material 22.

Figure 6:
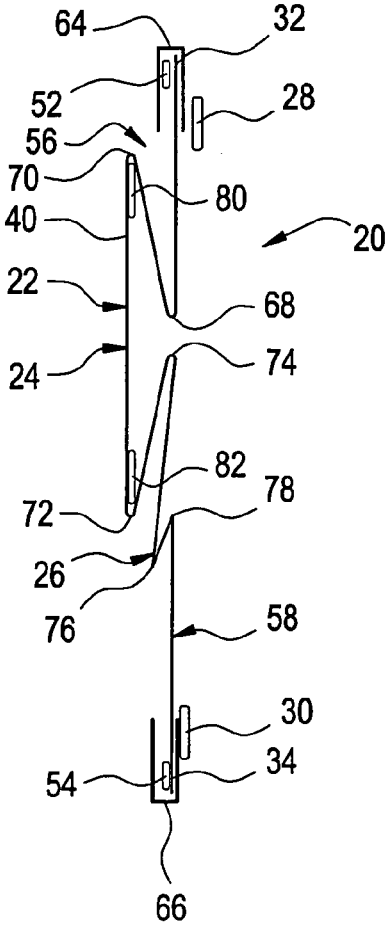
FIG. 6 is an exploded side view of the filter mask illustrated in FIG. 1 in a flat configuration prior to the filter mask being installed upon a wearer's face.
Figure 7:
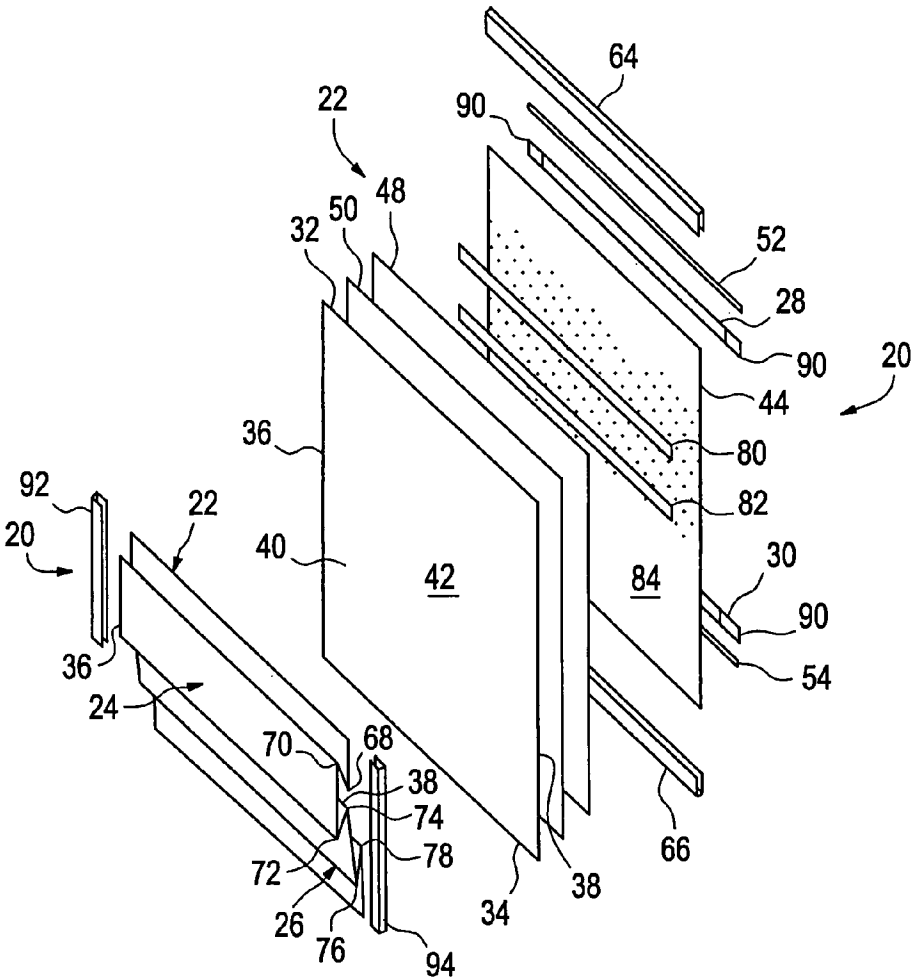
FIG. 7 is an exploded perspective view of the elements of the filter mask illustrated in FIG. 1 being formed into the filter mask illustrated in FIG. 1.

In the preferred embodiment of the filter mask 20, the filter material 22 includes an outer overstock or layer 40, as illustrated in FIG. 7. The outer layer 40 of the filter material 22 defines an outer surface 42 thereof which is exposed to the environment when the filter mask 20 is secured to a wearer's head. In the preferred embodiment, the filter material 22 also includes an inner overstock or layer 44, as illustrated in FIG. 7. The inner layer 44 of the filter material 22 defines an inner surface 46 thereof which is to worn next to the face of the wearer when the filter mask 20 is secured to the wearer's head. In the preferred embodiment, the filter material 22 also includes a first middle filter layer 48 and a second middle filter layer 50, as illustrated in FIG. 7. The first and second middle filter layers 48, 50 are preferably formed of melt blown polypropylene electrostatic with the first middle filter layer 48 being thirty gram melt blown polypropylene electrostatic and with the second middle filter layer 50 being forty gram melt blown polypropylene electrostatic. The first and second middle filter layers 48, 50 are not illustrated in FIGS. 2 and 6 for clarity purposes. Alternatively, the filter material could include only a single middle filter layer (not shown) which is preferably sixty gram melt blown polypropylene electrostatic. The weight and number of these filter layers 48, 50 can vary depending upon the requirements of the user of the mask 20.

Malleable stiffeners 52, 54 are secured to upper and lower portions 56, 58 respectively, of the filter material 22, as illustrated in FIGS. 6 and 7. It should be understood that the use of the term "malleable stiffener" herein is meant to include the use of both malleable and flexible stiffeners. It is preferred that the malleable stiffeners 52, 54 be placed directly next to the upper and lower edges 32, 34 of the filter material 22, respectively. Alternatively, the malleable stiffeners 52, 54 may be placed somewhere along the upper and lower portions 56, 58 of the filter material 22. The important property of the malleable stiffeners 52, 54 is that the material be pliant enough to be bent to a shape that conforms to the face of the wearer, and then retain that shape. In this regard, it is important that the malleable stiffeners 52, 54 not be too stiff so as to make it difficult for the wearer to conform the filter mask 20 upon installation. The malleable stiffeners 52, 54 are not illustrated in FIG. 2 for clarity purposes.

Generally, as used herein, the upper portion 56 of the filter mask 20 will refer to that portion which contacts the nose and cheek areas of the wearer while the lower portion 58 of the filter mask 20 will be that portion which is in proximity to the lower jaw and chin of the wearer. The malleable stiffeners 52, 54 are preferably formed of aluminum. However, the filter mask 20 may be constructed using a binding material which exhibits stiffening characteristics rather than using separate malleable stiffeners 52, 54.

The malleable stiffeners 52, 54 are preferably attached to the filter material 22 by encapsulating the malleable stiffeners 52, 54 within strips of heat activated tape 64, 66, as illustrated in FIG. 7, which becomes adhesive when it is heated. Thus, the heat activated tape 64 is provided around the upper edge 32 of the filter material 22 and encapsulates the malleable stiffener 52, while the heat activated tape 66 is provided around the lower edge 34 of the filter material 22 and encapsulates the malleable stiffener 54. Such heat activated tape 64, 66 is well known in the art and is commercially available. Encapsulating the malleable stiffeners 52, 54 within a binding of the heat activated tape 64, 66 provides a convenient structure for holding the malleable stiffeners 52, 54 in place.

Figure 4:
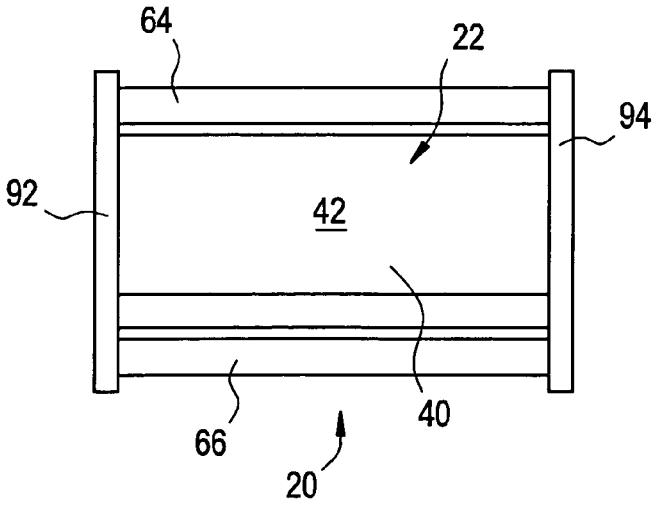
FIG. 4 is a front view of the filter mask illustrated in FIG. 1 in a flat configuration prior to the filter mask being installed upon a wearer's face.
Figure 5:
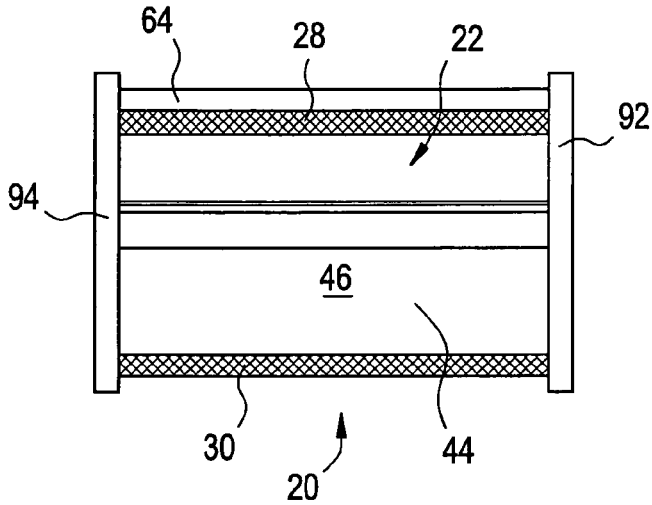
FIG. 5 is a rear view of the filter mask illustrated in FIG. 1 in a flat configuration prior to the filter mask being installed upon a wearer's face.

Of prime importance to the present invention is the formation of the pleats 24, 26 of the filter mask 20. As used herein, the term "pleat" refers to a relatively flat double-fold formed in the filter material 22 when the filter mask 20 is in the flat storage configuration, as illustrated in FIGS. 4–6.

The filter mask 20 includes an omega pleat 24 between the upper and lower edges 32, 34 of the filter mask 20, but which is more proximate to the upper edge 32 of the filter mask 20. The configuration of the omega pleat 24 can best be seen in FIGS. 6 and 7. The omega pleat 24 is so named because when the pleat 24 is partially expanded, the cross-section forms a shape roughly equivalent to the Greek letter omega (Ω). More particularly, the omega pleat 24 includes a first fold 68 which folds the filter material 22 such that the inner surface 46 of the filter material 22 is folded back onto itself toward the upper edge 32 of the filter material 22. The omega pleat 24 further includes a second fold 70 which folds the filter material 22 such that the outer surface 42 of the filter material 22 is folded back onto itself toward the lower edge 34 of the filter material 22. The omega pleat 24 further includes a third fold 72 which folds the filter material 22 such that the outer surface 42 of the filter material 22 is folded back onto itself toward the upper edge 32 of the filter material 22. The omega pleat 24 further includes a fourth fold 74 which folds the filter material 22 such that the inner surface 46 of the filter material 22 is folded back onto itself toward the lower edge 34 of the filter material 22.

The filter mask 20 also includes a secondary pleat 26 which is provided between the fourth fold 74 of the omega pleat 24 and the lower edge 34 of the filter mask 20. The secondary pleat 26 comprises a first fold 76 which folds the filter material 22 such that the outer surface 42 of the filter material 22 is folded back onto itself toward the upper edge 32 of the filter material 22. The secondary pleat 26 further includes a second fold 78 which folds the filter material 22 such that the inner surface 46 of the filter material 22 is folded back onto itself toward the lower edge 34 of the filter material 22.

Referring to FIGS. 6 and 7, stiffening members 80, 82 are provided in the vicinity of the omega pleat 24 within the filter material 22. While in this presently preferred embodiment, two stiffening members 80, 82 are shown, any desirable number could be used. The stiffening members 80, 82 may be adhered to, or embedded within, the filter material 22 of the filter mask 20. Preferably, the stiffening members 80, 82 are adhered to an adhesive (not shown) which is applied to an outer surface 84 of the inner layer 44. Stiffening member 80 is shown associated with the second fold 70 of the omega pleat 24 while stiffening member 82 is shown associated with the third fold 72 of the omega pleat 24. The stiffening members 80, 82 preferably extend parallel to, and substantially the entire length of, the second and third folds 70, 72 of the omega pleat 24 and may even extend to the side edges 36, 38 of the filter material 22. It should be noted that the filter mask 20 could be formed without using the stiffening members 80, 82 as well. The stiffening members 80, 82 are not illustrated in FIG. 2 for clarity purposes.

Referring to FIGS. 1, 3, 5 and 7, the filter mask 20 also has a pair of headbands 28, 30 which are adhered to the inner surface 46 of the filter mask 20. The headband 28 is adhered to the inner surface 46 of the filter mask 20 proximate to the upper edge 32 of the filter mask 20. The headband 30 is adhered to the inner surface 46 of the filter mask 20 proximate to the lower edge 34 of the filter mask 20. Each headband 28, 30 is secured at one end thereof proximate to the side edge 36 of the filter mask 20 while secured at the other end thereof proximate to the side edge 38 of the filter mask 20. The headbands 28, 30 are preferably secured to the inner surface 46 of the filter mask 20 by glue 90, as illustrated in FIG. 7, but could also be secured to the inner surface 46 of the filter mask 20 by any other suitable means. The headbands 28, 30 are preferably formed of elastic, but may be formed of string ties or ties with ear loops as well.

After the omega pleat 24 and the secondary pleat 26 are formed, after the stiffening members 80, 82 are associated with the omega pleat 24, and after the headbands 28, 30 are secured to the inner surface 46 of the filter mask 20, the side edges 36, 38 are bound as shown in FIGS. 4, 5 and 7. The side edges 36, 38 of the filter mask 20 are preferably bound with strips of heat activated tape 94, 96, but of course could be bound by other suitable means. The binding of the side edges 36, 38 of the filter mask 20 secures the pleats 24, 26, the stiffening members 80, 82 and the headbands 28, 30 into place.

With the filter mask 20 formed as described in connection with FIGS. 4–7, the filter mask 20, after installation on the face, takes on the configuration shown in FIGS. 1 and 2. As can be seen from FIG. 2, the upper malleable stiffener 52 provides that the filter material 22 is held against the nose and cheeks while the lower malleable stiffener 54 is twisted or folded to pull the side edges 36, 38 into the side of the face to provide a secure positive facial lock.

Figure 3:
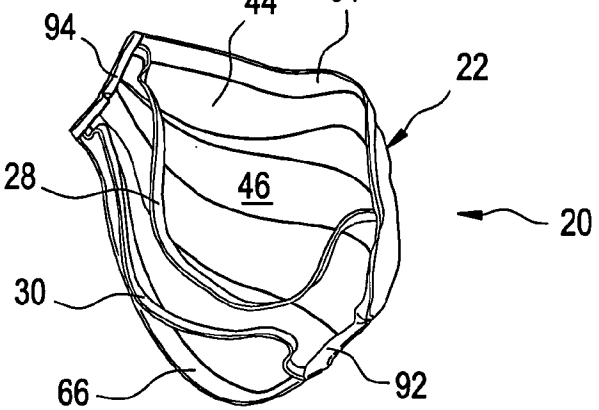
FIG. 3 is a perspective view of the filter mask illustrated in FIG. 1 taken from a reverse angle.

The configuration taken on by the filter mask 20 shown in FIGS. 1 and 2 when installed, can also be seen in the reverse angle perspective view of FIG. 3. In FIG. 3, the conforming function of the upper malleable stiffener 52 against the nose and cheek area can be readily seen. Furthermore, it can also be seen that the secondary pleat 26 allows the creation of a pocket-like shape by which the inner surface 46 of the filter material 22 is held tightly against the lower jaw area of the wearer. The lower malleable stiffener 54 increases the facial lock formed around the jaw.

The filter mask 20 is secured to the wearer's face to provide the positive facial lock by securing the headbands 28, 30 around the wearer's head, preferably with the headband 28 being secured above the ears of the wearer's head and preferably with the headband 30 being secured below the ears of the wearer's head.

As explained above, the headbands 28, 30 are preferably formed of elastic such that they will secure the filter mask 20 in the proper position on the wearer's face. Use of elastic headbands 28, 30 allows the filter mask 20 to be easily installed by the wearer and avoids the difficulty of tying a string tie behind the head. Furthermore, since the headbands 28, 30 are elastic, there is not the risk of the headbands 28, 30 becoming untied at an inopportune moment which accompanies the use of ordinary tie strings. Furthermore, the elasticity of the material of the headbands 28, 30 may be chosen so as to allow the filter mask 20 to be easily repositioned on the face while only using one hand.

By properly positioning the headbands 28, 30 and the secondary pleat 26 upon installation of the filter mask 20, a positive facial lock is provided not only along the upper and lower malleable stiffeners 52, 54, as shown in FIG. 1, but also along the side edges 36, 38 of the filter mask 20 which contact the cheeks, due to the effect of the tension exerted because of the cooperation of the secondary pleat 26 and the headbands 28, 30. Furthermore, the filter mask 20 still allows for normal speech without significant difficulty while maintaining a positive facial lock.

Also, with the stiffening members 80, 82 extending parallel with the second and third folds 70, 72 of the omega pleat 24 and the ends of the second and third folds 70, 72 being joined by heat activated tape 92, 94, any vertical opening of the omega pleat 24, which occurs when the headbands 28, 30 are secured to the wearer's head, will cause a foreshortening of the lateral dimension of the filter mask 20. This lateral foreshortening of the filter mask 20 causes a subsequent bowing of the stiffening members 80, 82 causing them to bow outwardly and support the filter material 20 away from the nose and mouth of the wearer.

It should be noted that the stiffening members 80, 82 may be fabricated from any suitable stiffening material such as a wire, plastic strip, polypropylene, or other material having a stiffening action so as to bow outwardly to create a breathing chamber and support the filter material 22 when the omega pleat 24 is opened. The breathing chamber makes the filter mask 20 seem cooler and it also holds the filter material 22 of the filter mask 20 away from the nose and mouth, thus helping prevent contamination of the mucous membranes from the bacteria that maybe on the filter mask 20. Desirably, the stiffening members 80, 82 have memory to return toward a flat configuration when the filter mask 20 is allowed to come to rest upon a flat surface.

It should further be noted that the use of the heat activated tape 64, 66, 92, 94 is presently preferred for any attaching function required during the fabrication of the present invention. In this regard, methods available for attaching the filter material 22 to other materials, or to itself, include sewing, gluing, ultrasonic bonding, or heat activated tape. While all of these methods can be used with the present invention, heat activated tape is presently the preferred method of attaching structures of the present invention. Each of the other three methods may be less advantageous for one reason or another.

For example, ultrasonic bonding often requires the use of expensive and complicated equipment and also requires that extreme care be taken to avoid metallic objects, such as the malleable stiffeners 52, 54, during the bonding process. Gluing, while providing a secure attachment, present the difficulty of allowing particles of glue to become dislodged into the environment as well as sometimes creating a "lump" of glue which may cause discomfort to the wearer as well as being inflexible.

Sewing is a common method of fabricating a filter mask. However, sewing also has potential drawbacks. First, sewing creates perforations in the filter material 22 which allow additional unfiltered air to pass from the inner surface of the filter mask to the outer surface and into the environment. Ultrasonic bonding may also create such perforations in the filter material 22. Further, sewing the filter materials 22 creates the potential that fibers from both the filter material 22 and the thread will be released into the environment as the filter mask 20 is worn. While such minute fibers are of little concern in a medical environment, in an industrial clean room such fiber are extremely undesirable. Furthermore, once the filter mask 20 is installed, the threads used in the sewing process, which are typically "harder" than the filter material 22, will abrade the filter material 22 causing additional fibers to be released into the environment as the filter mask 20 is worn.

Despite its disadvantages, sewing does provide the greatest strength of all of the methods. Thus, when sewing is used with the present invention, it is preferable that the seam afterwards be covered with heat activated tape to avoid release of fibers into the environment. Finally, the use of heat activated tape generally avoids the difficulties inherent in the other attachment methods. Thus, the edges 32, 34, 36, 38 of the filter material 22, rather than being left unfinished, are preferably bound by the heat activated tape 64, 66, 92, 94.

A further difficulty that is avoided by binding all edges 32, 34, 36, 38 of the filter material 22 by using the heat activated tape 64, 66, 92, 94 is that escape of microorganisms and water vapor through the spaces between the layers of a multilayer filter material 22 is prevented. Many types of three layer filter materials are constructed so that each layer of the filter material 22 is not completely bonded to the adjacent layers. Thus, interlayer spaces may be created which, if not sealed by binding the edges 32, 34, 36, 38, may allow migration of microorganisms from the interior of the filter mask 20 through the inner layer, and to the outside edges 32, 34, 36, 38 of the filter mask 20 into the environment.

Furthermore, individuals who wear eyeglasses also are plagued by the problem of fogging of their glasses due to condensation of warn, vapor laden exhaled air on the colder surface of their eyeglasses. Ensuring a positive facial lock along the upper edge 32 of the filter mask 20 helps to reduce fogging of eyeglasses due to the condensation of vapor laden air can be reduced. Still further, in many mask designs, vapor laden air is allowed to pass through the upper portion 56 of the filter material 22 and condense on the wearer's eyeglasses. By applying the heat activated tape 64 along the upper edge 32, a vapor barrier is created. This occurs because the applied heat activated tape 64 is relatively impervious to gases compared to the filter material 22. Thus, the heat activated tape 64 may be preferably applied to the uppermost one-half inch of the filter material 22. Use of the heat activated tape 64 in this fashion provides both a convenient method of attaching the malleable stiffeners 52, 54 to the filter material 22 and also a vapor barrier to minimize fogging of eyeglasses. It should be understood that other structures and materials can be used to form a vapor barrier.

The filter mask 20 with the omega pleat 24 and the secondary pleat 26 provides a better fit on a wider range of facial sizes and shapes than does the filter mask described and illustrated in U.S. Pat. No. 4,688,566. The reverse pleat described in the '566 patent is good when it is desired to only use one headband, but it did not allow for the best fit possible on some face sizes and shapes. The reverse pleat uses up materials that could be used to obtain a better fit. By not putting in the reverse pleat, there are more usable materials at the side of the face, thus allowing for a better fit.

Also, by not providing the reverse pleat of the '566 patent, but rather providing the omega pleat 24 and the secondary pleat 26, the malleable stiffeners 52, 54 may be provided at the top and bottom of the filter mask 20, thus providing more usable material at the side of the wearer's face for a better fit.

Further, by providing the filter mask 20 with two headbands 28, 30, the wearer has the ability to twist the malleable stiffener 54 provided at the lower edge 34 of the filter mask 20 for a custom fit, which is superior to the fit provided by the reverse pleat and the mask of the '566 patent.

While a preferred embodiment of the invention is shown and described, it is envisioned that those skilled in the art may devise various modifications without departing from the spirit and scope of the foregoing description and the appended claims.

The invention is claimed as follows:

1. A filter mask comprising:

filter material having an inner surface to be worn against a wearer's face, and an outer surface, said filter material comprising pleated means for folding and unfolding said filter material such that when folded said filter materials assumes an essentially flat storage configuration having upper, lower and side edges and such that when unfolded said filter material forms a mask adapted for placement on the wearer's head so as to cover the nose and mouth of the wearer, said pleated means comprising an omega pleat provided proximate to said upper edge in said essentially flat storage configuration and a secondary pleat provided between said omega pleat and said lower edge in said essentially flat storage configuration, said omega pleat providing a breathing chamber when unfolded, said secondary pleat providing a pocket adapted to fit over a chin of the wearer when unfolded, said secondary pleat comprises a first fold and a second fold; and means for securing said filter material to a head of the wearer.

2. A filter mask as defined in claim 1, further comprising a malleable stiffening member which is configured to conform said filter material to a nose and cheek area of the face of the wearer, said malleable stiffening member being attached to said filter material proximate to said upper edge thereof.

3. A filter mask as defined in claim 1, further comprising a malleable stiffening member which is configured to conform said filter material to a chin and jaw area of the face of the wearer, said malleable stiffening member being attached to said filter material proximate to said lower edge thereof.

4. A filter mask as defined in claim 1, wherein said omega pleat comprises a first fold, a second fold, a third fold and a fourth fold, said first fold of said omega pleat folds said filter material such that said inner surface of said filter material is folded back onto itself toward said lower edge of said filter material, said second fold of said omega pleat fold said filter material such tat said outer surface of said filter material is folded back onto itself toward said lower edge of said filter material, said third fold of said omega pleat folds said filter material such that said outer surface of said filter material is folded back onto itself toward said upper edge of said filter material, said fourth fold of said omega pleat folds said filter material such that said inner surface of said filter material is folded back onto itself toward said lower edge of said filter material.

5. A filter mask as defined in claim 4, wherein a stiffening member is operatively associated with said second fold of said omega pleat.

6. A filter mask as defined in claim 4, wherein a stiffening member is operatively associated with said third fold of said omega pleat.

7. A filter comprising:

filter material having an inner surface to be worn against a wearer's face, and an outer surface, said filter material comprising pleated means for folding and unfolding said filter material such that when folded said filter material assumes an essentially flat storage configuration having upper, lower and side edges and such that when unfolded said filter material forms a mask adapted for placement on the wearer's head so as to cover the nose and mouth of the wearer, said pleated means comprising am omega pleat provided proximate to said upper edge in said essentially flat storage configuration and a secondary pleat provided between said omega pleat and said lower edge in said essentially flat storage configuration, said omega pleat providing a breathing chamber when unfolded, said secondary pleat providing a pocket adapted to fit over a chin of the wearer when unfolded, wherein said omega pleat comprises a first fold, a second fold, a third fold and a fourth fold, said first fold of said omega pleat folds said filter material such that said inner surface of said filter material is folded back onto itself toward said lower edge of said filter material, said second fold of said omega pleat folds said filter material such that said outer surface of said filter material is folded back onto itself toward said lower edge of said filter material, said third fold of said omega pleat folds said filter material such that said outer surface of said filter material is folded back onto itself toward said upper edge of said filter material, said fourth fold of said omega pleat folds said filter material such that said inner surface of said filter material is folded back onto itself toward said lower edge of said filter material, said secondary pleat comprises a first fold and a second fold; and means for securing said filter material to a head of the wearer.

8. A filter mask as defined in claim 7, wherein said first fold of said secondary pleat folds said filter material such that said outer surface of said filter material is folded back onto itself toward said lower edge of said filter material, said second fold of said secondary pleat folds said filter material such that said inner surface of said filter material is folded back onto itself toward said lower edge of said filter material.

9. A filter mask as defined in claim 1, wherein said means for securing said filter mask comprises a pair of headbands which are secured to said filter material.

10. A filter mask as defined in claim 9, wherein said headbands are formed of an elastic material.

11. A filter mask as defined in claim 1, wherein said filter material comprises an outer layer, an inner layer and a middle layer of a material having a high filtration efficiency.

12. A filter mask as defined in claim 1, wherein said upper and lower edges of said filter material are bound by heat activated tape.

13. A filter mask as defined in claim 1, wherein said omega and secondary pleats are bound in place by heat activated tape.

14. A filter mask which, when folded, assumes an essentially flat storage configuration and which, when unfolded, assumes an installed configuration for covering the nostrils and mouth of a wearer, comprising:

flexible filtering means for filtering inhaled and exhaled air comprising:

inner and outer surfaces, said inner surface to be positioned against the wearer's face when said mask is in said installed configuration, upper and lower edges in said essentially flat storage condition, said upper edge to be provided proximate to the wearer's nose and cheeks when said mask is in said installed configuration, said lower edge to be provided proximate to the wearer's jaw and chin when said mask is in said installed configuration, an omega pleat provided proximate to said upper edge when said mask is in said essentially flat storage configuration, said omega pleat providing a breathing chamber when said mask is in said installed configuration, a secondary pleat provided between said omega pleat and said lower edge when said mask is in said essentially flat storage configuration, said secondary pleat providing a pocket adapted to fit over the chin of the wearer when said mask is in said installed configuration, said secondary pleat comprises a first fold and a second fold; and means for securing said flexible filtering means to the head of the wearer.

15. A filter in ask as defined in claim 14, further comprising a malleable stiffening member which is configured to conform said flexible filtering means to a nose and cheek area of the face of the wearer, said malleable stiffening ember being attached to said flexible filtering means proximate to said upper edge thereof.

16. A filter mask as defined in claim 14, further comprising a malleable stiffening member which is configured to conform said flexible filtering means to a chin and jaw area of the face of the wearer, said malleable stiffening member being attached to said flexible filtering means proximate to said lower edge thereof.

17. A filter mask as defined in claim 14, wherein said omega pleat comprises a first fold, a second fold, a third fold and a fourth fold, said first fold of said omega pleat folds said flexible filtering means such that said inner surface of said flexible filtering means is folded back onto itself toward said lower edge of said flexible filtering means, said second fold of said omega pleat folds said flexible filtering means such the said outer surface of said flexible filtering means is folded back onto itself toward said lower edge of said flexible filtering means, said third fold of said omega pleat folds said flexible filtering means such that said outer surface of said flexible filtering means is folded back onto itself toward said upper edge of said flexible filtering means, said fourth fold of said omega pleat folds said flexible filtering means such that said inner surface of said flexible filtering means is folded back onto itself toward said lower edge of said flexible filtering means.

18. A filter mask as defined in claim 17, wherein a stiffening member is operatively associated with said second fold of said omega pleat.

19. A filter mask as defined in claim 17, wherein a stiffening member is operatively associated with said third fold of said omega pleat.

20. A filter mask which, when folded, assumes an essentially flat storage configuration and which, when unfolded, assumes an installed configuration for covering the nostrils and mouth of a wearer, comprising:

flexible filtering means for filtering inhaled and exhaled air comprising:

inner and outer surfaces, said inner surface to be positioned against the wearer's face when said mask is in said installed configuration, upper and lower edges in said essentially flat storage condition, said upper edge to be provided proximate to the wearer's nose and cheeks when said mask is in said installed configuration, said lower edge to be provided proximate to the wearer's jaw and chin when said mask is in said installed configuration, an omega pleat provided proximate to said upper edge when said mask is in said essentially flat storage configuration, said omega pleat providing a breathing chamber, when said mask is in said installed configuration, said omega pleat comprises a first fold, a second fold, a third fold and a third fold, said first fold of said omega pleat folds said flexible filtering means such that said inner surface of said flexible filtering means is folded back onto itself toward said lower edge of said flexible filtering means, said second fold of said omega pleat folds said flexible filtering means such that said outer surface of said flexible filtering means is folded back onto itself toward said lower edge of said flexible filtering means, said third fold of said omega pleat folds said flexible filtering means such that said outer surface of said flexible filtering means is folded back onto itself toward said upper edge of said flexible filtering means, said fourth fold of said omega pleat folds said flexible filtering means such that said inner surface of said flexible filtering means is folded back onto itself toward said lower edge of said flexible filtering means, a secondary pleat provided between said omega pleat and said lower edge when said mask is in said essentially flat storage configuration, said secondary pleat providing a pocket adapted to fit over the chin of the wearer when said mask is in said installed configuration, said secondary pleat comprises a first fold and a second fold; and means for securing said flexible filtering means to the head of the wearer.

21. A filter mask as defined in claim 20, wherein said first fold of said secondary pleat folds said flexible filtering means such that said outer surface of said flexible filtering means is folded back onto itself toward said lower edge of said flexible filtering means, said second fold of said secondary pleat folds said flexible filtering means such that said inner surface of said flexible filtering means is folded back onto itself toward said lower edge of said flexible filtering means.

22. A filter mask as defined in claim 14, wherein said means for securing said filter mask comprises a pair of headbands which are secured to said flexible filtering means.

23. A filter mask as defined in claim 22, wherein said headbands are formed of an elastic material.

24. A filter mask as defined in claim 14, wherein said flexible filtering means comprises an outer layer, an inner layer and a middle layer of a material having a high filtration efficiency.

25. A filter mask as defined in claim 14, wherein raid upper and lower edges of said filter material are bound by heat activated tape.

26. A filter mask as defined in claim 14, wherein said omega and secondary pleats are bound in place by heat activated tape.

27. A filter mask comprising:

filter material having an inner surface to be worn against a wearer's face, and an outer surface, said filter material comprising pleated means for folding and unfolding said filter material such that when folded said filter materials assumes an essentially flat storage configuration having upper, lower and side edges and such that when unfolded said filter material forms a mask adapted for placement on the wearer's head so as to cover the nose and mouth of the wearer, said pleated means comprising an omega pleat provided proximate to said upper edge and a secondary pleat provided between said omega pleat and said lower edge, said omega pleat providing a breathing chamber when unfolded, said secondary pleat providing a pocket adapted to fit over a chin of the wearer when unfolded, said secondary pleat comprises a first fold and a second fold; and means for securing said filter material to a head of the wearer.

28. A filter mask which, when folded, assumes an essentially flat storage configuration and which, when unfolded, assumes an installed configuration for covering the nostrils and month of a wearer, comprising:

flexible filtering means for filtering inhaled and exhaled air comprising:

inner and outer surfaces, said inner surface to be positioned against the wearer's face when said mask is worn by the wearer, upper and lower edges, said upper edge to be provided proximate to the wearer's nose and cheeks when said mask is worn by the wearer, said lower edge to be provided proximate to the wearer's jaw and chin when said mask is worn by the wearer, an omega pleat provided proximate to said upper edge, said omega pleat providing a breathing chamber when said mask is worn by the wearer, a secondary pleat provided between said omega pleat and said lower edge, said secondary pleat providing a pocket adapted to fit over the chin of the wearer when said mask is worn by the wearer, said secondary pleat comprises a first fold and a second fold; and means for securing said flexible filtering means to the head of the wearer.

* * * * *

UNITED STATES PATENT AND TRADEMARK OFFICE

CERTIFICATE OF CORRECTION

PATENT NO. : 7,036,507 B2
APPLICATION NO. : 10/739245
DATED : May 2, 2006
INVENTOR(S) : John W. Jensen It is certified that error appears in the above-identified patent and that said Letters Patent is hereby corrected as shown below:

Column 12, Line 55 "fold" should be -- folds --

Column 12, Line 56 "tat" should be -- that --

Column 13, Line 14 " am" should be -- an --

Column 16, Line 1 " raid" should be -- said --

Signed and Sealed this

Fifth Day of September, 2006

JON W. DUDAS
*Director of the United States Patent and Trademark Office*